US007737674B2

(12) United States Patent
Erbito, Jr.

(10) Patent No.: US 7,737,674 B2
(45) Date of Patent: Jun. 15, 2010

(54) VOLTAGE REGULATOR

(75) Inventor: Rogelio L. Erbito, Jr., Singapore (SG)

(73) Assignee: Vanguard International Semiconductor Corporation, Hsinchu (TW)

( * ) Notice: Subject to any disclaimer, the term of this patent is extended or adjusted under 35 U.S.C. 154(b) by 195 days.

(21) Appl. No.: 11/833,160

(22) Filed: Aug. 2, 2007

(65) Prior Publication Data

US 2009/0033310 A1 Feb. 5, 2009

(51) Int. Cl.
*G05F 3/16* (2006.01)

(52) U.S. Cl. ..... 323/313

(58) Field of Classification Search ..... 323/272, 323/274, 282, 283, 312, 313, 351
See application file for complete search history.

(56) References Cited

U.S. PATENT DOCUMENTS

| | | | | |
|---|---|---|---|---|
| 6,046,577 | A * | 4/2000 | Rincon-Mora et al. | 323/282 |
| 6,313,615 | B1 * | 11/2001 | Fayneh et al. | 323/281 |
| 7,397,226 | B1 * | 7/2008 | Mannama et al. | 323/273 |
| 2004/0046532 | A1 * | 3/2004 | Menegoli et al. | 323/273 |

* cited by examiner

*Primary Examiner*—Adolf Berhane
(74) *Attorney, Agent, or Firm*—Quintero Law Office

(57) ABSTRACT

A voltage regulator. A pass element has a control gate and outputs an output voltage according to an input voltage and a control signal received from the control gate. A feedback circuit generates a feedback signal according to the output voltage. A bandgap circuit generates a reference voltage according to the output voltage. An amplifier generates a first signal according to the feedback signal and the reference voltage. A start-up circuit generates the control signal according to the reference voltage and the first signal.

24 Claims, 2 Drawing Sheets

VOLTAGE REGULATOR

BACKGROUND OF THE INVENTION

1. Field of the Invention

The invention relates to a voltage regulator, and more particularly to a voltage regulator with start-up circuit.

2. Description of the Related Art

A voltage regulator is designed to provide and maintain a constant voltage in electrical applications, wherein a low dropout (LDO) voltage regulator is a DC linear voltage regulator which has a very small input-output differential voltage and relatively low output noise.

FIG. 1 is a block diagram of a conventional LDO voltage regulator 100. The LDO voltage regulator 100 comprises a bandgap circuit 110, an amplifier 120, a feedback circuit 130 and a pass element 140, wherein the feedback circuit 130 has two resistors R1 and R2. An input voltage $V_{in}$ is coupled to the pass element 140, and is also coupled to the bandgap circuit 110 and the amplifier 120 as a supply voltage. The bandgap circuit 110 generates a reference voltage $V_{ref}$, which is a stable voltage, according to the input voltage $V_{in}$. The amplifier 120 receives the reference voltage $V_{ref}$ and a feedback signal $V_{FB}$, and then generates a control signal $V_g$ to control the pass element 140. The pass element 140 outputs an output voltage $V_{out}$ according to the input voltage $V_{in}$ and the control signal $V_g$. Then, the feedback circuit 130 generates the feedback signal $V_{FB}$ according to the output voltage $V_{out}$. Therefore, by comparing the reference voltage $V_{ref}$ and the feedback signal $V_{FB}$, the LDO voltage regulator 100 controls the pass element 140 according to a difference between the reference voltage $V_{ref}$ and the feedback signal $V_{FB}$ to supply the output voltage $V_{out}$ to a load circuit 150.

In FIG. 1, the reference voltage $V_{ref}$ is generated according to the input voltage $V_{in}$. For this reason, if noise interferes with the input voltage $V_{in}$, the reference voltage $V_{ref}$ will also be disrupted with the noise, thus varying the voltage value of the reference voltage $V_{ref}$, such that the output voltage $V_{out}$ does not obtain a desired voltage value. Meanwhile, the output voltage $V_{out}$ is coupled to the bandgap circuit 110 as a supply voltage, to improve the performance (e.g. line regulation) of the voltage regulator, and hence the output voltage $V_{out}$ is not disrupted with the noise from the input voltage $V_{in}$.

However, the output voltage $V_{out}$ remains at a low voltage level when the voltage regulator is in an initial state, and the supply voltage of the bandgap circuit 110 is not high enough to individually power up the bandgap circuit 110. Thus, the reference voltage $V_{ref}$ will remain at a low voltage level along with the output voltage $V_{out}$. If the output voltage $V_{out}$ is the supply voltage of the bandgap circuit 110, power up of the voltage regulator will be difficult. Therefore, a start-up circuit is desired to solve the above problem.

BRIEF SUMMARY OF THE INVENTION

Voltage regulators are provided. An exemplary embodiment of a voltage regulator comprises: an input terminal for receiving an input voltage; a pass element having a control gate for outputting an output voltage according to the input voltage and a control signal received from the control gate; a feedback circuit for generating a feedback signal according to the output voltage; a bandgap circuit for generating a reference voltage according to the output voltage; an amplifier for generating a first signal according to the feedback signal and the reference voltage; and a start-up circuit for generating the control signal according to the reference voltage and the first signal.

Another exemplary embodiment of a voltage regulator comprises: an input terminal for receiving an input voltage; a pass element coupled between the input terminal and an output terminal having a control gate and outputting an output voltage according to the input voltage and a control signal received from the control gate; a feedback circuit for generating a feedback signal according to the output voltage; a bandgap circuit for generating a reference voltage according to the output voltage; an amplifier for generating a first signal according to the feedback signal and the reference voltage; and a start-up circuit for generating the control signal. The start-up circuit comprises: a first current source coupled between the input terminal and the control gate; a first transistor coupled between the control gate and a node having a first gate; a first switch coupled between the node and the output terminal; a second switch coupled between the node and a ground terminal; a third switch coupled between the first gate and the amplifier; and a fourth switch coupled between the first gate and the ground terminal. The first and fourth switches are turned on and the second and third switches are turned off if the voltage regulator is in an initial state, and the first and fourth switches are turned off and the second and third switches are turned on if the voltage regulator is in an operation state.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
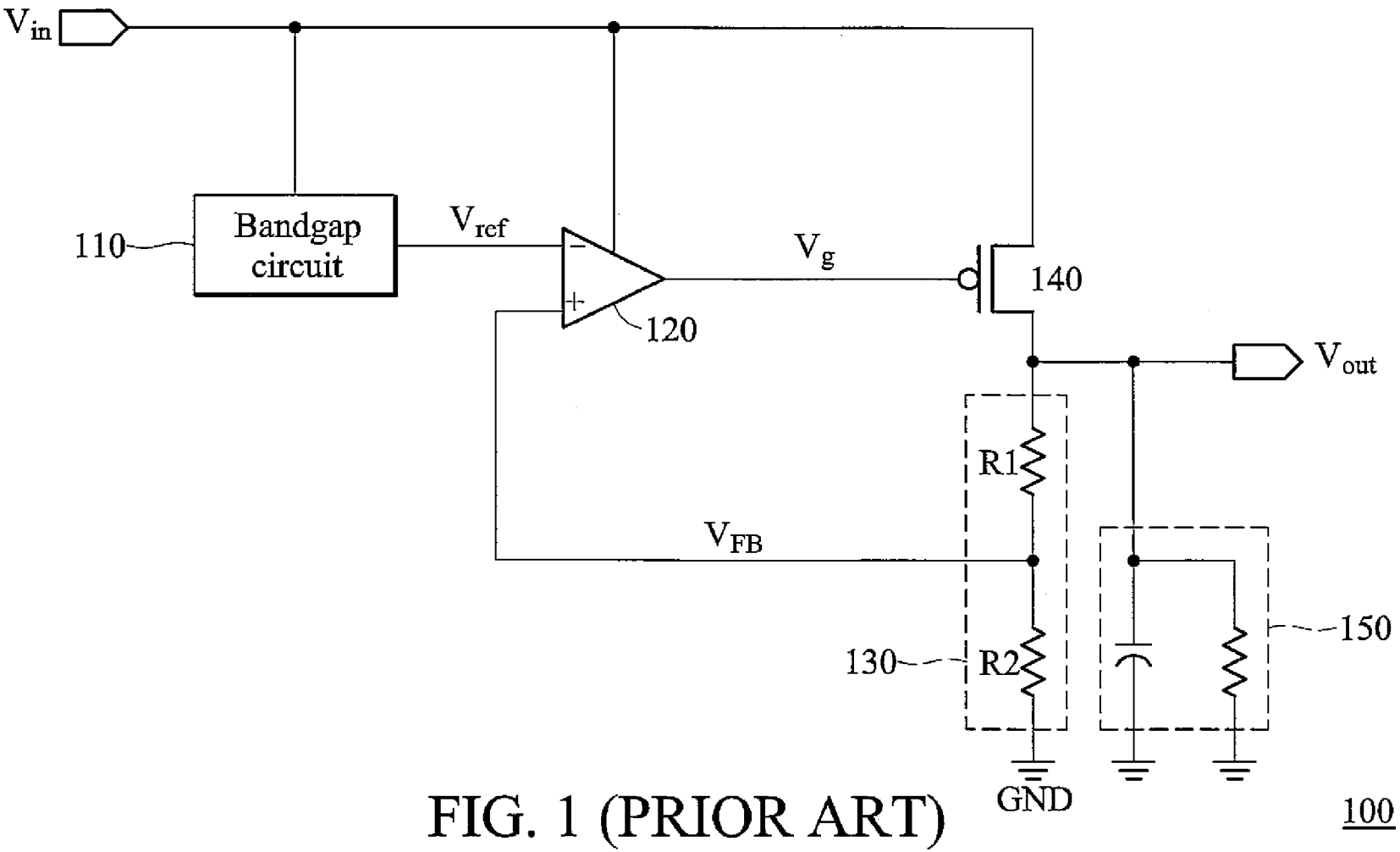
FIG. 1 (PRIOR ART)
FIG. 1 is a block diagram of a conventional low dropout voltage regulator.
Figure 2:
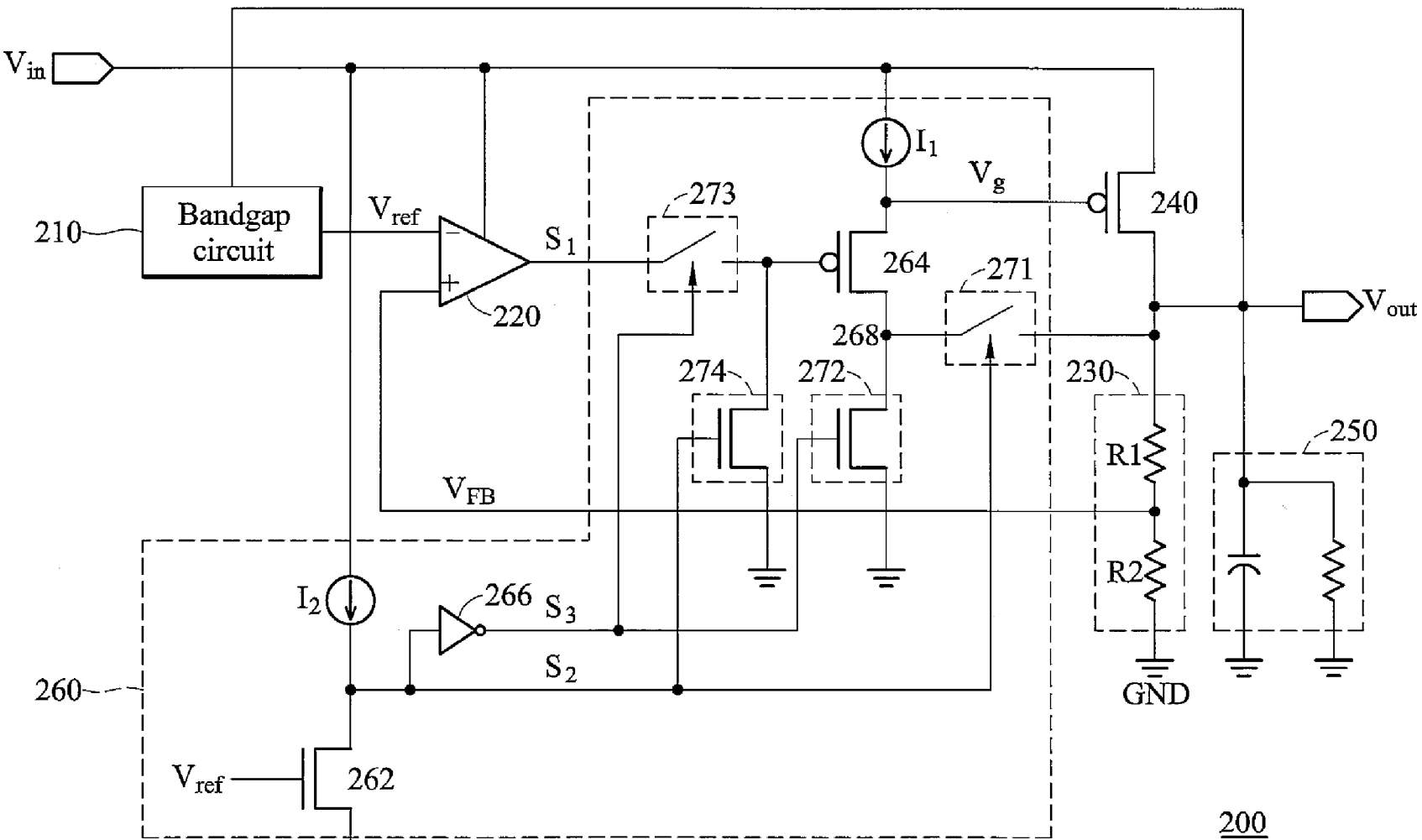
FIG. 2 is a block diagram of a voltage regulator according to an embodiment of the invention.

FIG. 2 is a block diagram of a voltage regulator 200 according to an embodiment of the invention. The voltage regulator 200 comprises a bandgap circuit 210, an amplifier 220, a feedback circuit 230, a pass element 240 and a start-up circuit 260. The feedback circuit 230 has two resistors R1 and R2, wherein the resistor R1 is coupled to the pass element 240 and the resistor R2 is coupled between the resistor R1 and a ground terminal GND. An input voltage $V_{in}$ received from an input terminal of the voltage regulator 200 is coupled to the amplifier 220, the pass element 240 and the start-up circuit 260, wherein the input voltage $V_{in}$ is a supply voltage of the amplifier 220 and the start-up circuit 260. The bandgap circuit 210 generates a reference voltage $V_{ref}$, which is a stable voltage, according to an output voltage $V_{out}$. The amplifier 220 receives the reference voltage $V_{ref}$ and a feedback signal $V_{FB}$ to generate a signal $S_1$ which is transmitted to the start-up circuit 260. The amplifier 220 has a non-inverting input and an inverting input for receiving the feedback signal $V_{FB}$ and the reference voltage $V_{ref}$, respectively. Hence, the amplifier 220 generates a signal $S_1$ according to a difference between the reference voltage $V_{ref}$ and the feedback signal $V_{FB}$. In one embodiment, the amplifier 220 is an error amplifier.

Furthermore, the start-up circuit 260 comprises two current sources $I_1$ and $I_2$, two transistors 262 and 264, an inverter 266 and four switches 271-274. The current source $I_2$ is coupled to the input voltage $V_{in}$, and the transistor 262 is coupled between the current source $I_2$ and the ground terminal GND. The reference voltage $V_{ref}$ is received by a gate of the transistor 262 and then the transistor 262 is controlled to generate a signal $S_2$ according to the reference voltage $V_{ref}$. The inverter 266 receives the signal $S_2$ to generate a signal $S_3$. The transistor 264 is coupled between the current source $I_1$ and the switch 272. The switch 271 is coupled between a node 268 and the output voltage $V_{out}$, the switch 273 is coupled between the amplifier 220 and a gate of the transistor 264, and the switch 274 is coupled between the gate of the transistor 264 and the ground terminal GND. The switches 271 and 274 are controlled by the signal $S_2$ to turn on or off, and the switches 272 and 273 are controlled by the signal $S_3$ to turn on or off. The start-up circuit 260 generates a control signal $V_g$ to a control gate of the pass element 240 according to the signal $S_1$ and the reference voltage $V_{ref}$. The output voltage $V_{out}$ is outputted by the pass element 240 according to the input voltage $V_{in}$ and the control signal $V_g$, wherein the pass element 240 is a P type metal oxide semiconductor (MOS) transistor. In one embodiment, the switch may be a PNP bipolar transistor. The feedback circuit 230 is coupled between the pass element 240 (i.e. an output terminal of the voltage regulator 200) and the ground terminal GND, and generates the feedback signal $V_{FB}$ according to the output voltage $V_{out}$.

For example, if the voltage level of the input voltage $V_{in}$ is low, the voltage levels of all signals in the voltage regulator 200 are also low. When the input voltage $V_{in}$ begins to rise from an initial state, the control gate of the pass element 240 will remain at a low voltage level, such that a gate to source voltage of the pass element 240 is increased, i.e. a voltage difference between the control gate and the input voltage $V_{in}$ is increased. Then, the input voltage $V_{in}$ is continually increased. If the gate to source voltage of the pass element 240 is higher than a threshold voltage of the pass element 240, a load circuit 250 is charged by the input voltage $V_{in}$ through the pass element 240 to increase the output voltage $V_{out}$. However, the output voltage $V_{out}$ is not high enough to individually power up the bandgap circuit 210, while the reference voltage $V_{ref}$, remaining at low voltage level, is also not high enough to individually turn on the transistor 262. Hence, the signal $S_2$ is a high voltage level, and the inverter 266 changes the signal $S_3$ to a low voltage level.

Furthermore, the switches 271 and 274 are turned on by the signal $S_2$, and the switches 272 and 273 are turned off by the signal $S_3$. Since the switch 273 is turned off, the signal $S_1$ generated by the amplifier 220 is not transmitted to the start-up circuit 260. Meanwhile, since the switch 271 is turned on, the output terminal of the voltage regulator 200 electrically connects to the node 268. Moreover, the transistor 264 is turned on because the gate of the transistor 264 is coupled to the ground terminal GND through the switch 274. Thus, when both the transistor 264 and the switch 271 are turned on, the load circuit 250 is charged by the input voltage $V_{in}$ through the current source $I_1$ and the diode connected pass element 240.

Next, the bandgap circuit 210 is powered up to generate the reference voltage $V_{ref}$ as the output voltage $V_{out}$ increases gradually. The transistor 262 is turned on if the reference voltage $V_{ref}$ reaches a desirable value. Following, the signal $S_2$ is changed to a low voltage level, and the signal $S_3$ is changed to a high voltage level. In the meanwhile, the switches 271 and 274 are turned off by the signal $S_2$, and the switches 272 and 273 are turned on by the signal $S_3$. The signal $S_1$ generated by the amplifier 220 is transmitted to the start-up circuit 260 through the switch 273 to generate the control signal $V_g$, wherein the transistor 264 may be configured as a source follower circuit or a buffer circuit. Finally, the bandgap circuit 210, the amplifier 220, the feedback circuit 230, the pass element 240 and the start-up circuit 260 form a feedback loop to regulate the output voltage $V_{out}$. The output voltage $$V_{out} \text{ is} \left(1 + \frac{R2}{R1}\right) \times V_{ref},$$

hence the voltage regulator 200 generates the output voltage $V_{out}$ according to the reference voltage $V_{ref}$ and a ratio of the resistor R1 and the resistor R2.

As shown in FIG. 2, the transistors 262 and 264 are NMOS and PMOS transistors respectively. In addition, both the switches 272 and 274 are NMOS transistors.

In this embodiment of the invention, the switches 271 and 274 are turned on while the switches 272 and 273 are turned off if the voltage regulator 200 is in an initial state. The output terminal of the voltage regulator 200 is charged by the input voltage $V_{in}$ through the current source $I_1$, the transistor 264 and the switch 271 and through the diode connected formed pass transistor 240. If the output voltage $V_{out}$ has enough voltage to power up the bandgap circuit 210, i.e. the voltage regulator 200 is in an operation state, the switches 271 and 274 are turned off and the switches 272 and 273 are turned on. Hence, the voltage regulator 200 forms a feedback loop to regulate a designed value of the output voltage $V_{out}$.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A voltage regulator, comprising:

an input terminal for receiving an input voltage;

a pass element having a control gate, for outputting an output voltage according to the input voltage and a control signal received from the control gate;

a feedback circuit for generating a feedback signal according to the output voltage;

a bandgap circuit for generating a reference voltage according to the output voltage;

an amplifier for generating a first signal according to the feedback signal and the reference voltage; and a start-up circuit for generating the control signal according to the reference voltage and the first signal.

2. The voltage regulator as claimed in claim 1, wherein the pass element is one of PMOS and PNP bipolar transistors.

3. The voltage regulator as claimed in claim 1, wherein the feedback circuit is coupled between the pass element and a ground terminal.

4. The voltage regulator as claimed in claim 3, wherein the feedback circuit comprises a first resistor coupled to the pass element and a second resistor coupled between the first resistor and the ground terminal.

5. The voltage regulator as claimed in claim 4, wherein the voltage regulator generates the output voltage according to the reference voltage and a ratio of the first resistor and the second resistor.

6. The voltage regulator as claimed in claim 1, wherein the amplifier comprises a non-inverting input and an inverting input for receiving the feedback signal and the reference voltage respectively.

7. The voltage regulator as claimed in claim 6, wherein the amplifier generates the first signal according to a difference between the feedback signal and the reference voltage.

8. The voltage regulator as claimed in claim 7, wherein the amplifier is an error amplifier.

9. The voltage regulator as claimed in claim 1, wherein the start-up circuit comprises:

a first current source coupled between the input terminal and the control gate;

a second current source coupled to the input terminal;

a first transistor coupled between the second current source and a ground terminal for outputting a second signal, wherein the first transistor has a first gate for receiving the reference voltage;

an inverter for receiving the second signal to generate a third signal;

a second transistor coupled between the first current source and a node, having a second gate;

a third transistor coupled between the node and the ground terminal, having a third gate for receiving the third signal;

a fourth transistor coupled between the second gate and the ground terminal, having a fourth gate for receiving the second signal;

a first switch coupled between the node and the output voltage, having a first control terminal for receiving the second signal; and a second switch coupled between the second gate and the amplifier, having a second control terminal for receiving the third signal.

10. The voltage regulator as claimed in claim 9, wherein the second switch is turned off if the first switch is turned on, and the second switch is turned on if the first switch is turned off.

11. The voltage regulator as claimed in claim 9, wherein the second transistor is a PMOS transistor, and the first, third and fourth transistors are NMOS transistors.

12. A voltage regulator, comprising:

an input terminal for receiving an input voltage;

a pass element coupled between the input terminal and an output terminal, having a control gate and outputting an output voltage according to the input voltage and a control signal received from the control gate;

a feedback circuit for generating a feedback signal according to the output voltage;

a bandgap circuit for generating a reference voltage according to the output voltage;

an amplifier for generating a first signal according to the feedback signal and the reference voltage; and a start-up circuit for generating the control signal, comprising:

a first current source coupled between the input terminal and the control gate;

a first transistor coupled between the control gate and a node, having a first gate;

a first switch coupled between the node and the output terminal;

a second switch coupled between the node and a ground terminal;

a third switch coupled between the first gate and the amplifier; and a fourth switch coupled between the first gate and the ground terminal, wherein the first and fourth switches are turned on and the second and third switches are turned off if the voltage regulator is in an initial state, and the first and fourth switches are turned off and the second and third switches are turned on if the voltage regulator is in an operation state.

13. The voltage regulator as claimed in claim 12, wherein the pass element is one of PMOS and PNP bipolar transistors.

14. The voltage regulator as claimed in claim 12, wherein the first transistor is a PMOS transistor.

15. The voltage regulator as claimed in claim 12, wherein the feedback circuit is coupled between the output terminal and the ground terminal.

16. The voltage regulator as claimed in claim 15, wherein the feedback circuit comprises a first resistor coupled to the output terminal and a second resistor coupled between the first resistor and the ground terminal.

17. The voltage regulator as claimed in claim 16, wherein the voltage regulator generates the output voltage according to the reference voltage and a ratio of the first resistor and the second resistor.

18. The voltage regulator as claimed in claim 12, wherein the amplifier comprises a non-inverting input and an inverting input for receiving the feedback signal and the reference voltage respectively.

19. The voltage regulator as claimed in claim 18, wherein the amplifier generates the first signal according to a difference between the feedback signal and the reference voltage.

20. The voltage regulator as claimed in claim 19, wherein the amplifier is an error amplifier.

21. The voltage regulator as claimed in claim 12, wherein the start-up circuit controls the first, second, third and fourth switches according to the reference voltage.

22. The voltage regulator as claimed in claim 21, wherein the start-up circuit further comprises:

a second current source coupled to the input terminal; and a second transistor coupled between the second current source and the ground terminal, having a second gate for receiving the reference voltage, wherein the start-up circuit generates a second signal to control the first and fourth switches according to the reference voltage.

23. The voltage regulator as claimed in claim 22, wherein the start-up circuit further comprises an inverter for generating a third signal according to the second signal to control the second and third switches.

24. The voltage regulator as claimed in claim 22, wherein the second transistor is an NMOS transistor.

* * * * *